US006142182A

United States Patent [19]

Akimoto

[11] Patent Number: 6,142,182

[45] Date of Patent: Nov. 7, 2000

[54] BASE-MOUNTED ELECTROMAGNETIC VALVE

[75] Inventor: Takashi Akimoto, Ibaraki, Japan

[73] Assignee: SMC Corporation, Tokyo, Japan

[21] Appl. No.: 09/292,734

[22] Filed: Apr. 16, 1999

[30] Foreign Application Priority Data

May 14, 1998 [JP] Japan ..... 10-132154

[51] Int. Cl.[7] ..... F15B 13/043

[52] U.S. Cl. ..... 137/625.64; 137/884

[58] Field of Search ..... 137/271, 625.64, 137/884

[56] References Cited

U.S. PATENT DOCUMENTS

| | | | |
|---|---|---|---|
| 3,323,547 | 6/1967 | N.W. Van Husen, Jr. et al. . | |
| 4,557,292 | 12/1985 | Nicolas et al. . | |
| 4,889,164 | 12/1989 | Hozumi et al. . | |
| 5,234,033 | 8/1993 | Stoll et al. . | |
| 5,333,647 | 8/1994 | Fukano et al. . | |
| 5,964,244 | 10/1999 | Hiramatsu et al. | 137/625.64 X |
| 5,996,609 | 12/1999 | Akimoto et al. | 137/625.64 X |

FOREIGN PATENT DOCUMENTS

| | | |
|---|---|---|
| 0 800 002 | 10/1997 | European Pat. Off. . |
| 0 864 762 | 9/1998 | European Pat. Off. . |
| 2603160 | 1/1997 | Japan . |

OTHER PUBLICATIONS

Patent Abstract of Japan, vol. 017, No. 068 (M–1365), Feb. 10, 1993, JP 04 272583, Sep. 29, 1992.

S. M. C. Pneumatique S.A., 1125a Energie Fluide, vol. 28, No. 7 pp. 40 to 43, "Evolution Dans Le Montage Et La Connectique Des Distributeurs Directonnels Pneumatiques", Nov. 1, 1989.

*Primary Examiner*—Gerald A. Michalsky

*Attorney, Agent, or Firm*—Oblon, Spivak, McClelland, Maier & Neustadt, P.C.

[57] ABSTRACT

To obtain a base-mounted electromagnetic valve, wherein removal and mounting of a pilot valve of the electromagnetic valve is facilitated to allow its assembly, maintenance and the like to be carried out easily simply by incorporating a simple power supply mechanism between a base member and the electromagnetic valve. In order to achieve this object, a recessed portion disposed on a joint surface with a pilot valve and a fit-in portion capable of fitting into a recess wherein power supply sockets of the base member are formed are provided in an intermediate block which separably connects a main valve portion of the electromagnetic valve with a pilot valve portion, and a relay connector which separably connects lead-in terminals of said pilot valve portion with the power supply sockets of the base member is provided within said recessed portion.

5 Claims, 3 Drawing Sheets

BASE-MOUNTED ELECTROMAGNETIC VALVE

FIELD OF THE INVENTION

The present invention relates to a base-mounted electromagnetic valve, wherein an electromagnetic valve for changing over passages of a working fluid is mounted on a base member such as a manifold with pipe ports and power supply sockets for supplying power and a subplate.

PRIOR ART

Base-mounted electromagnetic valves of this sort are, as disclosed in Japanese Patent Laid-Open No. 2603160, generally provided with power supply sockets on the base member side for connection to a power source, and pin-shaped power receiving terminals for connection to a solenoid is placed on the electromagnetic valve side such that the power receiving terminal is connected to the power supply socket when the electromagnetic valve is mounted on the base member.

In the case of such a base-mounted electromagnetic valve, when mounting an electromagnetic valve on a base member, for the sake of a work procedure and an inspection procedure, it is desirable to have a construction wherein not only a finished electromagnetic valve can be mounted but also a semifinished electromagnetic valve without a pilot valve is mounted first and the pilot valve can be installed afterward. Also, in the case when maintenance checks of an electromagnetic valve in use are made, it is desirable to have a construction such that a pilot valve alone is removable while the electromagnetic valve remains mounted on the base member.

However, since many of conventional base-mounted electromagnetic valves are generally provided with power receiving terminals and solenoids fixedly connected to each other, it has been difficult to mount pilot valves afterward during assembly or to replace the pilot valves alone when maintenance services are made.

Also, there have been quite a few base-mounted electromagnetic valves whose externally exposed portions of electric conductors might contact tools, hands and so on.

SUMMARY OF THE INVENTION

It is therefore a technological object of the present invention to provide a base-mounted electromagnetic valve efficiently constructed so as to permit a pilot valve to be mounted, removed and so on easily simply by incorporating a simple power supply mechanism between a base member and an electromagnetic valve, and to facilitate assembly, inspection processes, maintenance services and so on.

It is another technological object of the present invention to permit the above-described base-mounted electromagnetic valve to be electrically connected easily and safely without being mistakenly connected when mounting or removing the pilot valve.

In accordance with the present invention, the above-stated objectives are achieved by the provision of a base-mounted electromagnetic valve comprising a base member having pipe ports and power supply sockets for supplying power, and an electromagnetic valve mounted on the base member.

The above base member has the power supply sockets connected to a power source and received in a recess formed on an electromagnetic valve mounting surface.

On the other hand, the above electromagnetic valve has a main valve portion having a valve member for changing over working fluids, a pilot valve portion having an electromagnetic pilot valve operating the above valve member, and an intermediate block disposed between the main valve portion and the pilot valve portion. The above pilot valve portion has a circuit board incorporating a protective circuit electrically connected to a solenoid of the pilot valve, and a plurality of pin-shaped lead-in terminals with one end connected to the protective circuit of the circuit board and the other end extending toward the above intermediate block. Further, the above intermediate block has a recessed portion formed on a joint surface with the pilot valve, and a cylindrical fit-in portion which is formed on a joint surface with the base member and fits in the above recessed portion. Also, the intermediate block is provided with a relay connector which detachably connects the lead-in terminals of the above pilot valve with the power supply sockets of the base member.

Since the base-mounted electromagnetic valve of the present invention has a construction such that the power supply sockets of the base member and the lead-in terminals of the pilot valve portion are detachably connected by way of the relay connector provided in the intermediate block, not only can a finished electromagnetic valve be mounted on the base member during assembly of the base-mounted electromagnetic valve, but also a semifinished electromagnetic valve without a pilot valve is mounted first, and then the pilot valve can be installed afterward. Also, the pilot valve alone can be detached or attached during maintenance, which considerably facilitates assembly and inspection processes or maintenance and other services of the base member.

Moreover, since all that is required is to incorporate the relay connector in the intermediate block, the power supply mechanism can be a quite simple one.

According to a specific embodiment of the present invention, the above relay connector has a plurality of relay sockets connectable to each of the lead-in terminals of the pilot valve portion, a relay board with the relay sockets mounted thereon, a plurality of pin-shaped relay terminals with one end being attached to the relay board to be electrically connected to each of the relay sockets and the other end extending in the fit-in portion, and a terminal holder holding the relay terminals and the relay board.

It is desirable that the above terminal holder is removably mounted in a recessed portion of the intermediate block by resilient hooks provided on the side surfaces.

According to another specific embodiment of the present invention, pin-shaped solenoid terminals extending from a solenoid and the above lead-in terminals are respectively provided such that they protrude from the other side of the mounting surface of the above pilot valve to the intermediate block. In addition, a protective wall to surround these terminals for safety is formed, and the above circuit board is removably attached to the above solenoid terminals and the lead-in terminals in such a manner that each of the terminals is fitted in a plurality of board sockets on the circuit board within the above protective wall.

Also, in the present invention, the pilot valve portion has a cover entirely covering the pilot valve and the circuit board, the circuit board is mounted inside the cover, and the respectively board sockets are connected to solenoid terminals and lead-in terminals by fastening the cover to the intermediate block.

With the above-described construction, after mounting the pilot valve on the intermediate block, the pilot valve portion can be easily and promptly installed simply by mounting a cover. Also, an operation can be carried out safely, as possibilities of wrongly connections and contacts to externally exposed conductor portions are precluded.

DESCRIPTION OF THE PREFERRED EMBODIMENTS

Figure 1:
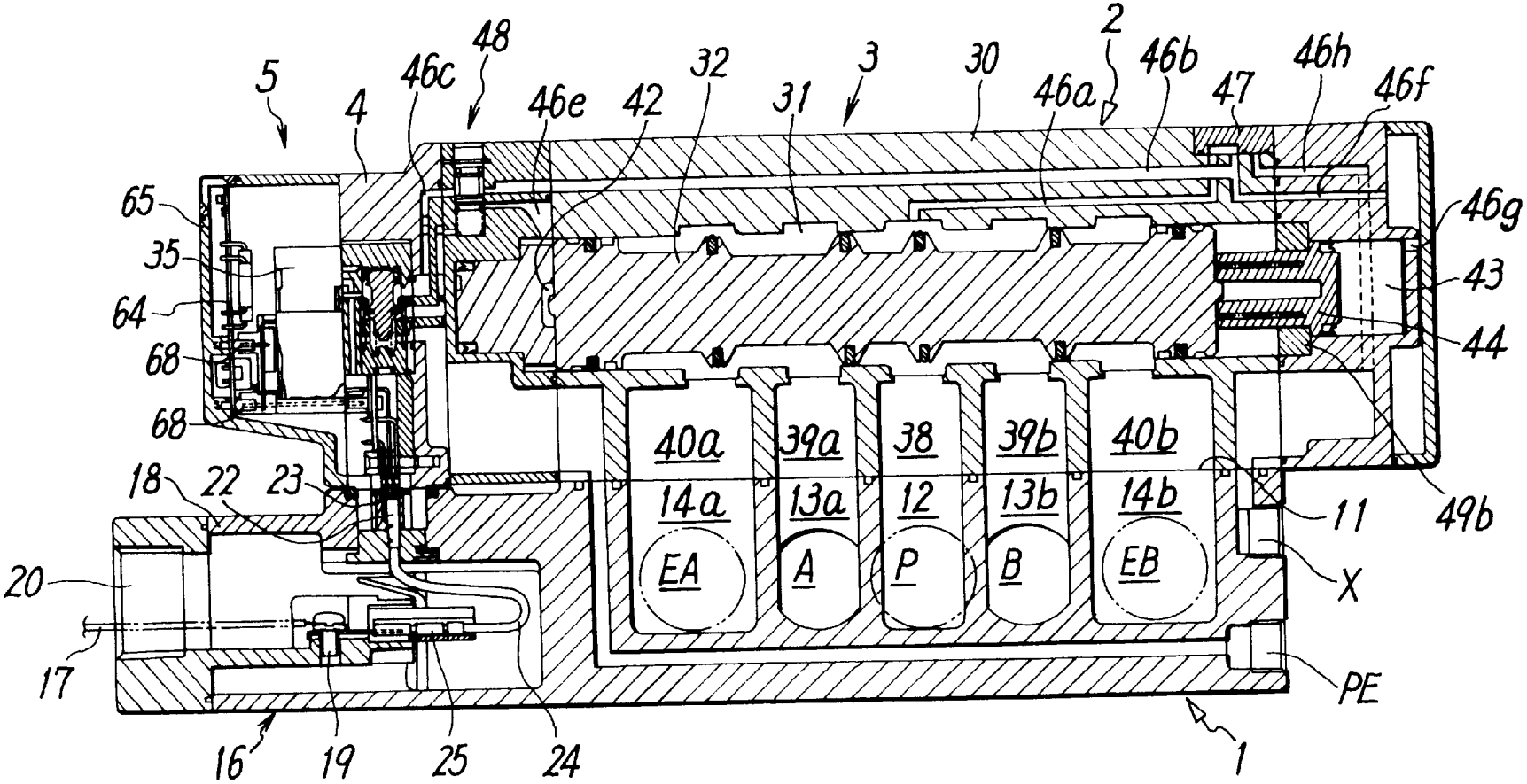
FIG. 1 is a sectional view of a base-mounted electromagnetic valve according to an embodiment of the present invention.

FIG. 1 shows a preferred embodiment of a base-mounted electromagnetic valve according to the present invention. The base-mounted electromagnetic valve illustrated therein comprises a base member 1 such as a manifold or a subplate, and an electromagnetic valve 2 mounted on the base member 1.

A valve mounting surface 11 on which the electromagnetic valve 2 is mounted is formed on a top surface of the base member 1, and in the base member 1 are formed respectively a supply through hole 12 for a working fluid opened in the valve mounting surface 11, two output through holes 13*a*, 13*b*, and two discharge through holes 14*a*, 14*b* . The above supply through hole 12 and two discharge through holes 14*a*, 14*b* are individually in communication with a supply port P and two exhaust ports EA, EB opened on the side surface seen in the front of the drawing, and two output through holes 13*a*, 13*b* are individually in communication with two output ports A, B opened in a side surface of the opposite side of the valve in the drawing.

In the drawing, PE is a pilot exhaust port opened in the front end face of the base member 1, and X is an external pilot port introducing an external pilot fluid.

Figure 2:
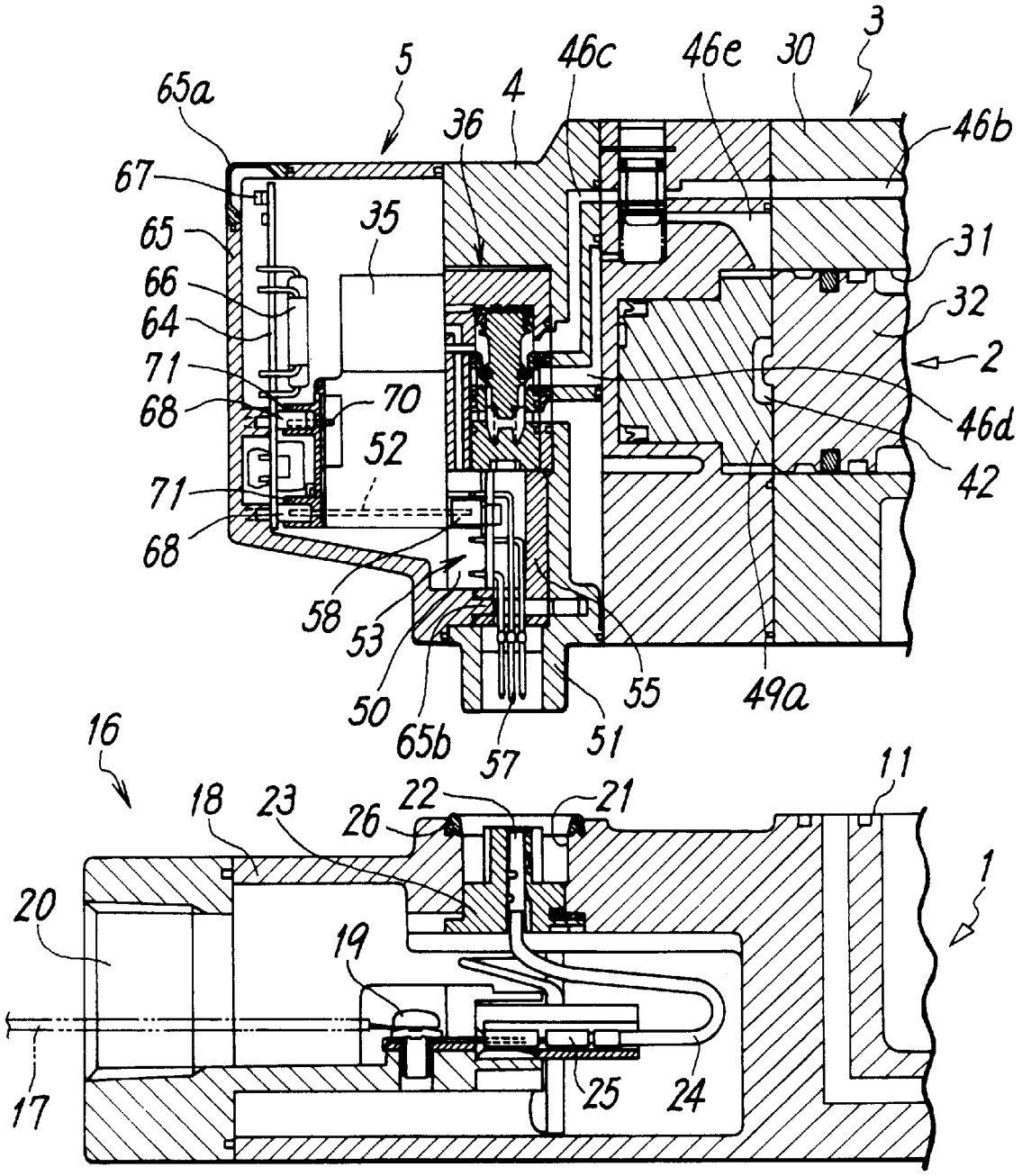
FIG. 2 is a separately shown enlarged view of a principal part of FIG. 1.

At a rear end portion of the base member 1, a power supply portion 16 for supplying power to the electromagnetic valve 2 is formed. As seen in FIG. 2, the power supply portion 16 has a hollow terminal box 18 housing a plurality of connecting terminals 19 for connection to a feeder 17 from a power source, a feeder introduction port 20 for introducing the feeder 17 into the terminal box 18, a recess 21 formed on the valve mounting surface 11, a plurality of power supply sockets 22 disposed in the recess 21 while being held by a socket holder 23, and a lead 24 and a connector 25 connecting the power supply sockets 22 to the respective connecting terminals 19. The numeral 26 denotes a sealing member.

On the other hand, the above electromagnetic valve 2 is a single pilot type 5-port valve and is provided with a main valve portion 3 and a pilot valve portion 5. The main valve portion 3 has a parallelepiped valve body 30 extending longitudinally and having a rectangular section. Into a valve hole 31 formed in the valve body 30 is inserted a spool type valve member 32 for changing over passages of a working fluid from one to another. Also, the pilot valve portion 5 is provided with an electromagnetic pilot valve 35 for operating the valve member 32, and the main valve portion 3 and the pilot valve portion 5 are coupled together separably by means of an intermediate block 4, -which incorporates an amplifier valve 36 for amplifying a pilot fluid.

In the valve body 30 of the main valve portion 3 are provided a supply through hole 38 for individual communication with each through hole on the valve mounting surface 11 of the base member 1, two output through holes 39*a*, 39*b*, and two discharge through holes 40*a*, 40*b* . Each of these through holes is in communication with the valve hole 31.

At both ends of the valve member 32 are formed a large-diameter pressure chamber 42 for allowing the pilot fluid to operate on the valve member 32 directly, and a small-diameter pressure chamber 43 for allowing the pilot fluid to operate by way of a piston 44. The large-diameter pressure chamber 42 is in communication with the supply through hole 38 via pilot passages 46*a*, 46*b*, 46*c*, 46*d* and 46*e* by way of a passage change-over means 47, a manual operation mechanism 48, the amplifier valve 36 and the pilot valve 35. On the other hand, the small-diameter pressure chamber 43 is in constant communication with the supply through hole 38 via pilot passages 46*a*, 46*f* and 46*g* by way of the passage change-over means 47. As a result, like a conventional single pilot valve, the pilot valve 35 is turned on and off to supply and discharge the pilot fluid to and from the large-diameter pressure chamber 42, or a manual operation mechanism 48 is manipulated to bring the large-diameter pressure chamber 42 directly in communication with the supply through hole 38 or block the above communication, to operate the valve member 32.

In the drawing, 49*a* and 49*b* are cushioning members to absorb impacting force at stroke ends of the valve member 32.

The above-described passage change-over means 47 is for the changing of the electromagnetic valves 2 between an internal pilot type and an external pilot type. The valve shown in the drawing is the internal pilot type leading the pilot fluid into the pilot valve 35 through the pilot passage 46*a* branched off from the supply through hole 38, and by mounting the passage change-over means 47 in such a way that its left and right shown in the drawing are reversed, the pilot passage 46*a* is blocked and the pilot passages 46*b*, 46*f* can be connected to an external pilot passage 46h, which is in communication with the external pilot port X.

The above intermediate block 4 has a recessed portion 50 which is formed on a joint surface with the pilot valve 35, and a cylindrical fit-in portion 51 for fitting in the recess 21 is formed on the joint surface with the base member 1. Also in the recessed portion 50, there is a relay connector 53 mounted for separably connecting a plurality of pin-shaped lead-in terminals 52 formed in the pilot valve portion 5 to the power supply socket 22 on the base member 1.

Figure 3:
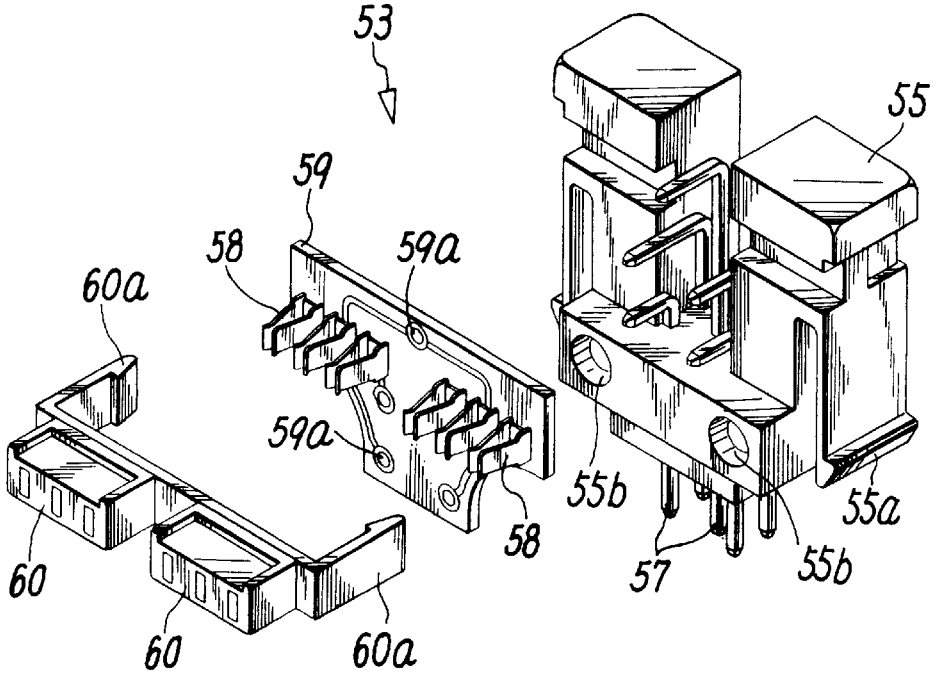
FIG. 3 is an exploded view in perspective of a relay connector.

The above relay connector 53 is constructed as shown in FIG. 3. This relay connector 53 is provided with two sets of members for electric connection so as to be used even when the electromagnetic valve 2 is switched to a double pilot type. Namely, the relay connector 53 comprises the terminal holder 55 formed of insulating material such as a synthetic resin, a plurality of pin-shaped relay terminals 57 attached sot that they are pressed into mounting holes of the terminal holder 55 with one end protruding toward the side of the base member 1 and the other end formed in L shape to face the side of the pilot valve 35, a plurality of relay sockets 58 into which end portions of the respective lead-in terminals 52 are fitted to be connected, a relay board 59 provided with the relay sockets 58, and socket covers 60 being resiliently attached to the relay board 59 by means of pawls 60*a* and covering the relay sockets 58. Further, an end portion of the relay terminal 57 is inserted into a contact hole 59*a* of the relay board 59 and soldered, whereby each of the relay terminals 57 and the relay sockets 58 are connected to each other, and the relay board 59 is mounted to the terminal holder 55.

The terminal holder 55 is provided with resilient hooks 55*a* on both side faces, and is detachably mounted to the intermediate block 4 by resiliently engaging the hooks 55*a* to the intermediate block 4 in the recessed portion 50. However, the terminal holder 55 can be mounted to the intermediate block 4 by means of screws instead of the hooks 55*a*.

The terminal holder 55 may be provided with a set of electrically connecting members alone.

Furthermore, the pilot valve portion 5 has the pilot valve 35 mounted to the intermediate block 4, a circuit board 64 mounted on a side opposite to a mounting surface of the pilot valve 35 to the intermediate block 4, and a cover 65 entirely covering the pilot valve 35 and the circuit board 64.

The circuit board 64 incorporates a protective circuit having a diode 66 for prevention of a counter electromotive force and other purposes, and a light-emitting diode 67 for displaying an electric flow state by wiring printed on the surface thereof. Also, there are provided a plurality of board sockets 68 electrically connected to the protective circuit, and the circuit board 64 is mounted inside the cover 65. The portion of the cover 65 that faces the light-emitting diode 67 is a transparent display window 65*a*.

On the other hand, provided on a mounting surface of the pilot valve 35 to the circuit board 64 are a pin-shaped solenoid terminal 70 extending from a solenoid and the lead-in terminal 52 passing through the pilot valve 35, and a protective wall 71 is further provided so as to completely or partially surround these terminals 52, 70 respectively. Moreover, when the cover 65 is mounted after installation of the pilot valve 35 to the intermediate block 4, each of the board sockets 68 respectively fits the solenoid terminal 70 and the lead-in terminal 52 within the protective wall 71, allowing the circuit board 64 to be automatically mounted to the pilot valve 35. At this time, as seen in FIG. 2, the cover 65 and the terminal holder 55 are positioned in such a manner that the projections 65*b* formed on the cover 65 fit in the holes 55*b* of the terminal holder 55.

In a base-mounted electromagnetic valve having above construction, the power supply socket 22 of the base member 1 and the lead-in terminal 52 of the pilot valve portion 5 are separably connected by way of the relay connector 53 provided in the intermediate block 4 so that not only can a finished electromagnetic valve 2 be mounted on the base member 1 during assembly of the base-mounted electromagnetic valve but also a semifinished electromagnetic valve 2 without the pilot valve 35 can be mounted first, followed by later installation of the pilot valve 35. Also, the pilot valve 35 and the terminal holder 55 can be easily detached or attached by removing the cover 65 during maintenance. Therefore, above construction is advantageous not only for assembly and inspection processes of the base-mounted electromagnetic valve but also for maintenance services and so on.

Moreover, since the above effect is achieved simply by incorporating the relay connector 53 into the intermediate b lock 4, a power supply mechanism can be a quite simple one.

Figure 4:
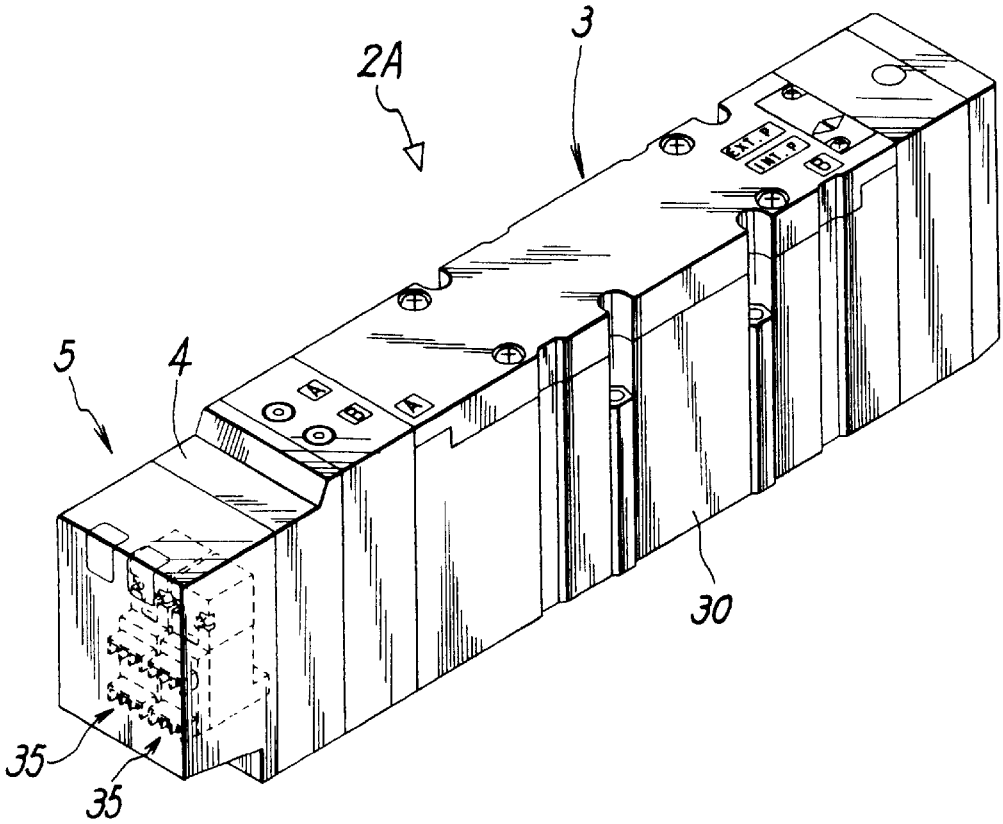
FIG. 4 is a perspective view illustrating another form of the electromagnetic valve.

Although the above-described embodiment is of a single pilot type electromagnetic valve 2, the electromagnetic valve may be a double pilot type electromagnetic valve 2A as shown in FIG. 4. In this case, the pilot valve portion 5 is provided with two pilot valves 35, 35. Though these pilot valves 35, 35 may be formed separately and placed side by side on the intermediate block 4, the two pilot valves 35, 35 may be integrated by being sealed into a synthetic resin. Also, it is needless to say that, in the case of a double pilot type, two sets of terminals, sockets, manual operation mechanisms and the like are provided respectively to correspond with the two pilot valves.

Moreover, the electromagnetic valves applicable are not limited to 5-port valves, and other electromagnetic valves having a different number of ports such as 3-port valves, 4-port valves and 2-port valves may be used.

As shown in the above construction according to the invention, the power supply sockets of the base member and the lead-in terminals of the pilot valve portion are separably connected by way of the relay connector provided in the intermediate block so that it is possible not only to mount a finished electromagnetic valve on the base member during assembly of a base-mounted electromagnetic valve, but also to mount a semifinished electromagnetic valve without a pilot valve first and to install the pilot valve afterward. Further, it is also possible to detach or attach the pilot valve alone when maintenance is made, which is considerably advantageous for assembly and inspection procedures, maintenance services and the like of the base member.

Moreover, since incorporating the relay connector in the intermediate block is all that is needed, construction of a power supply mechanism can be made quite simple.

What is claimed is:

1. A base-mounted electromagnetic valve comprising:

a base member having pipe ports and power supply sockets for supplying power, and an electromagnetic valve mounted on said base member;

said base member receiving said power supply socket connected to a power source in a recess formed on the valve mounting surface;

said electromagnetic valve having a main valve portion having a valve member for changing over working fluids, a pilot valve portion having an electromagnetically operated pilot valve operating said valve member, and an intermediate block disposed between said main valve portion and said pilot valve portion;

said pilot valve portion having a circuit board incorporating a protective circuit electrically connected to a solenoid of said pilot valve, and a plurality of pin-shaped lead-in terminals with one end connected to said protective circuit of said circuit board and the other end extending toward said intermediate block; and said intermediate block having a recessed portion formed on a joint surface with said pilot valve and a cylindrical fit-in portion formed on a joint surface with the base member and fitting in said recess, and being provided with a relay connector capable of separably connecting the lead-in terminals of said pilot valve portion with the power supply sockets of the base member in said recessed portion.

2. A base-mounted electromagnetic valve as defined in claim 1, wherein said relay connector has a plurality of relay sockets connectible to each lead-in terminal of said pilot valve portion, a relay board provided with said relay sockets, a plurality of relay terminals with one end electrically connected to each relay socket by being attached to said relay board and the other end being in the shape of a pin extending in said fit-in portion, and a terminal holder holding said relay terminals and said relay board.

3. A base-mounted electromagnetic valve as defined in claim 2, wherein said terminal holder is mounted removably in the recessed portion of said intermediate block by resilient hooks provided on side surfaces.

4. A base-mounted electromagnetic valve as defined in claim 2, wherein pin-shaped solenoid terminals extending from a solenoid and said lead-in terminals respectively projecting therefrom are provided on the opposite side of the mounting side of said pilot valve to the intermediate block, a protective wall for safety is formed around each of the terminals, and said circuit board is removably mounted to said solenoid terminals and lead-in terminals by fitting a plurality of board sockets mounted on said circuit board into each of the terminals inside said protective wall.

5. A base-mounted electromagnetic valve as defined in claim 4, wherein said pilot valve portion has a cover covering a pilot valve and a circuit board wholly, said circuit board being mounted inside said cover, and each of said board sockets being connected to a solenoid terminal and a lead-in terminal by mounting said cover to an intermediate block.

* * * * *